US008070996B2

(12) United States Patent
Tozzi-Spadoni et al.

(10) Patent No.: US 8,070,996 B2
(45) Date of Patent: Dec. 6, 2011

(54) PROCESS FOR THE PRODUCTION OF FLAME-RETARDANT VISCOSE FIBRES

(75) Inventors: Francesco Tozzi-Spadoni, Milan (IT); Andrea Seghizzi, Magenta (IT); Giovanni Patritti, Trecate (IT)

(73) Assignee: LENZING Aktiengesellschaft, Lenzing (AT)

( * ) Notice: Subject to any disclaimer, the term of this patent is extended or adjusted under 35 U.S.C. 154(b) by 297 days.

(21) Appl. No.: 12/361,113

(22) Filed: Jan. 28, 2009

(65) Prior Publication Data

US 2010/0190402 A1 Jul. 29, 2010

(51) Int. Cl.
*D01F 2/06* (2006.01)
*B27N 9/00* (2006.01)
*B32B 27/04* (2006.01)

(52) U.S. Cl. ..... 264/188; 264/195; 428/920; 428/921; 428/364; 428/365; 442/141; 442/414

(58) Field of Classification Search ..... 442/414, 442/141; 428/920, 921, 364, 365; 264/188, 264/195
See application file for complete search history.

(56) References Cited

U.S. PATENT DOCUMENTS

| | | | | |
|---|---|---|---|---|
| 3,266,918 | A * | 8/1966 | Schappel et al. | 106/18.18 |
| 4,220,472 | A * | 9/1980 | Mauric et al. | 106/18.18 |
| 2002/0113336 | A1* | 8/2002 | Cass et al. | 264/187 |
| 2007/0205402 | A1* | 9/2007 | Shrivastava et al. | 252/601 |

FOREIGN PATENT DOCUMENTS

| | | |
|---|---|---|
| CS | 8609247 | 6/1988 |
| DE | 41 28 638 A1 | 3/1992 |
| FR | 2 138 400 | 1/1973 |
| GB | 1 487 937 | 10/1977 |
| SU | 661047 | 5/1979 |

OTHER PUBLICATIONS

Erich E. Treiber, "Cellulose Chemistry and its Applications—Chapter 18: Formation of fibers from cellulose solutions", Ellis Horwood Limited, XP002480100, 1985, pp. 455-479.
Andrew G. Wilkes, "Regenerated Cellulose Fibres—Chapter 3: The Viscose Process", Woodhead Publishing Limited, XP002480101, 2001, 25 Pages.
Marjeet S. Choudhary, et al., Investigation of the Action of Flame Retardants in Cellulose. I. Investigation of the Flame Retardant Action of 2,2'-Oxybis(5,5-Dimethyl-1,3,2-Dioxaphosphorinane-2,2'-Disulfide) in Cellulose, Journal of Applied Polymer Science, vol. 30, No. 11, XP002479984, Nov. 1985, pp. 4345-4355.
Letter dated Apr. 5, 2011 from Mark Pohl, Pharmaceutical Patent Attorneys, LLC to Norca L. Torres-Velazquez, United States Patent and Trademark Office.
Citation of Prior Art under 35 U.S.C. § 301 filed in the United States Patent and Trademark Office on Feb. 23, 2011.

(Continued)

*Primary Examiner* — Norca L Torres Velazquez
(74) *Attorney, Agent, or Firm* — Oblon, Spivak, McClelland, Maier & Neustadt, L.L.P.

(57) ABSTRACT

The present invention relates to a process for the production in continuous of cellulose-based flame-retardant fibres or filaments and textile articles obtained therefrom, comprising the predispersion in water of an organophosphoric additive, the dosing and mixing of the aqueous predispersion in a solution of cellulose xanthogenate, the filtration of the mixed solutions and spinning in a regenerating and coagulation bath.

18 Claims, 2 Drawing Sheets

OTHER PUBLICATIONS

Clariant, "Exolit 5060 Dispersion, Highly Efficient and Permanent Flame Retardant for Regenerated Cellulose Fibres for Incorporation in the Spinning Mass," pp. 1-11. (2002).

R. Wolf, "Flame Retardant Viscose Rayon Containing a Pyrophosphate", Ind. Eng. Chem. Prod. Res. Dev., vol. 20, No. 3, pp. 413-420. (1981).

R. Jeffries, et al. "Clothing for Work and Protection," Lenzinger Berichte, Heft 67, pp. 25-33, Aug. 1989.

B.B. Koutu, et al. "Synthesis of a Flame-Retardant Dope Additive Dithiopyrophosphate and its Effect on Viscose Rayon Fibres", Indian Journal of Fibre & Textile Research, vol. 21, pp. 140-142, Jun. 1996.

A.R. Horrocks et al., "Flame Retardation of Conventional Textile Fibres", Handbook of Technical Textiles, p. 234. (2000).

A.R. Horrocks et al., "Table 4.15 Compatible Flame Retardant Cellulosic Fibres and Intumescents", Fire Retardant Materials, p. 173. (2001).

* cited by examiner

PROCESS FOR THE PRODUCTION OF FLAME-RETARDANT VISCOSE FIBRES

The present invention relates to a process for the production of flame-retardant viscose fibres.

In particular, the present invention relates to a process for producing a continuous multifilament viscose fibre having flame-retardant properties.

Viscose fibres, also called Rayon, are artificial fibres obtained starting from cellulose, a flammable substance of a vegetable origin.

Viscose fibres are obtained by the transformation of cellulose into a soluble derivative, sodium cellulose xanthogenate or xanthate, using a typical wet spinning process.

The production process is developed on batch or semi-batch plants and envisages the following main processing phases: —Wetting In this phase soaking is effected with caustic soda (17-20%) to swell the fibres and form the cellulose alkali, enabling attack with respect to the alcoholic —OH and the dissolution of the hemicellulose:

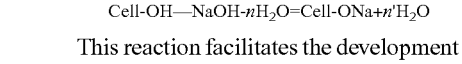

$$\text{Cell-OH}+\text{NaOH}+H_2O=\text{Cell-OH—NaOH-}nH_2O$$

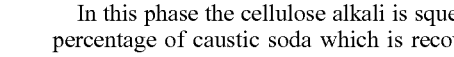

$$\text{Cell-OH—NaOH-}nH_2O=\text{Cell-ONa}+n'H_2O$$

This reaction facilitates the development of the subsequent reactions. —Squeezing In this phase the cellulose alkali is squeezed reducing the percentage of caustic soda which is recovered (IAC soda). —Disintegration and Curing of the Cellulose Alkali.

The curing phase consists in a controlled demolition, of an oxidative nature, of the cellulose polymers, using the oxygen of the air to reduce the average polymerization degree of the cellulose. In order to guarantee the correct equilibrium between the optimum viscosity of the spinning solution and the textile characteristics of the fibre produced, it is important to keep the fundamental parameters such as time and temperature, under strict control. —Xanthation In the xanthation phase gaseous carbon sulphide ($CS_2$) is added to the mass, which by reacting with the soda, forms the intermediate compound dithiocarbonate; this acts on the cellulose alkali giving rise to sodium cellulose xanthogenate.

Xanthogenate is a cellulose ester with dithiocarbonic acid ($H_2OCS_2$).

The reaction product of cellulose with the sulphide is not a homogeneous compound, the cellulose chains in fact initially have different esterification degrees, but after a time a redistribution takes place, which homogenizes the whole product.

At the end of the xanthation, the mass is discharged into the mixer where dissolution takes place under stirring, at a low temperature. At this point the liquid mass is finally "viscose", an orange-yellow-coloured liquid having a high viscosity and a penetrating odour due to the various sulphur compounds and elemental sulphur dissolved in the solution. —Curing of the Viscose The time period which precedes the spinning is called viscose curing. A polymeric and xanthic reassessment takes place in the liquid mass which leads to a reduction in the viscosity to a minimum value, and an increase in the instability of the xanthogenate, i.e. a greater tendency towards coagulation.

During the curing phase, which lasts 1-2 days, the viscose is subjected to other treatment necessary for improving its performance during extrusion. —Elimination of the contaminants present as foreign particles, generally fragments of non-dissolved cellulose and common dirt.

This is normally effected in two filtering steps (1st filtration with Funda equipment, second filtration with filter presses), with increasing severity.

De-Aeration

This phase has the purpose of eliminating the air bubbles englobed and above all the air dissolved in the mass, whose presence is extremely dangerous during extrusion. —Spinning During the spinning phase, the cellulose is regenerated from the viscose in fibrous form: at the outlet of the die hole the viscose encounters the coagulation bath which causes the coagulation of the viscose and hydrolysis of the xanthogenate. The filaments obtained under the stretching action in plastic phase are orientated and the yarn obtained then passes through various purification and preparation operations for subsequent uses.

Although the viscose fibres obtained according to the conventional techniques are applied in various sectors of the textile industry, they have the disadvantage of being easily flammable.

Attempts made for providing viscose fibres with flame-retardant characteristics have so far proved to be completely unsatisfactory.

These attempts are based on the "direct addition to the fibres" or "indirect addition to the solution" of alkaline viscose to be spun, of substances which inhibit or delay combustion, so-called flame-retardant additives.

As these substances are typically in solid and insoluble form, when they are applied as powders with a reduced particle-size directly to the yarn they have proved to be completely inappropriate for preventing combustion.

Furthermore, the addition of flame-retardant additives to the viscose mass to be spun causes a series of drawbacks mainly during the spinning phase. In most cases, a reduction has been observed, which can also be considerable, in the mechanical resistance properties of the yarn, above all when the dimensions are reduced.

One of the general objectives of the present invention therefore consists in providing a process for the production of a continuous viscose fibre having fire-resistance which can substantially reduce the drawbacks described above.

An objective of the invention consists in providing a process for the production of flame-retardant cellulose-based fibres which does not substantially jeopardize the mechanical resistance properties of the fibres themselves.

A further objective of the invention consists in providing means and operating procedures for producing a continuous viscose yarn having flame-retardant properties without changing its mechanical properties.

Figure 1:
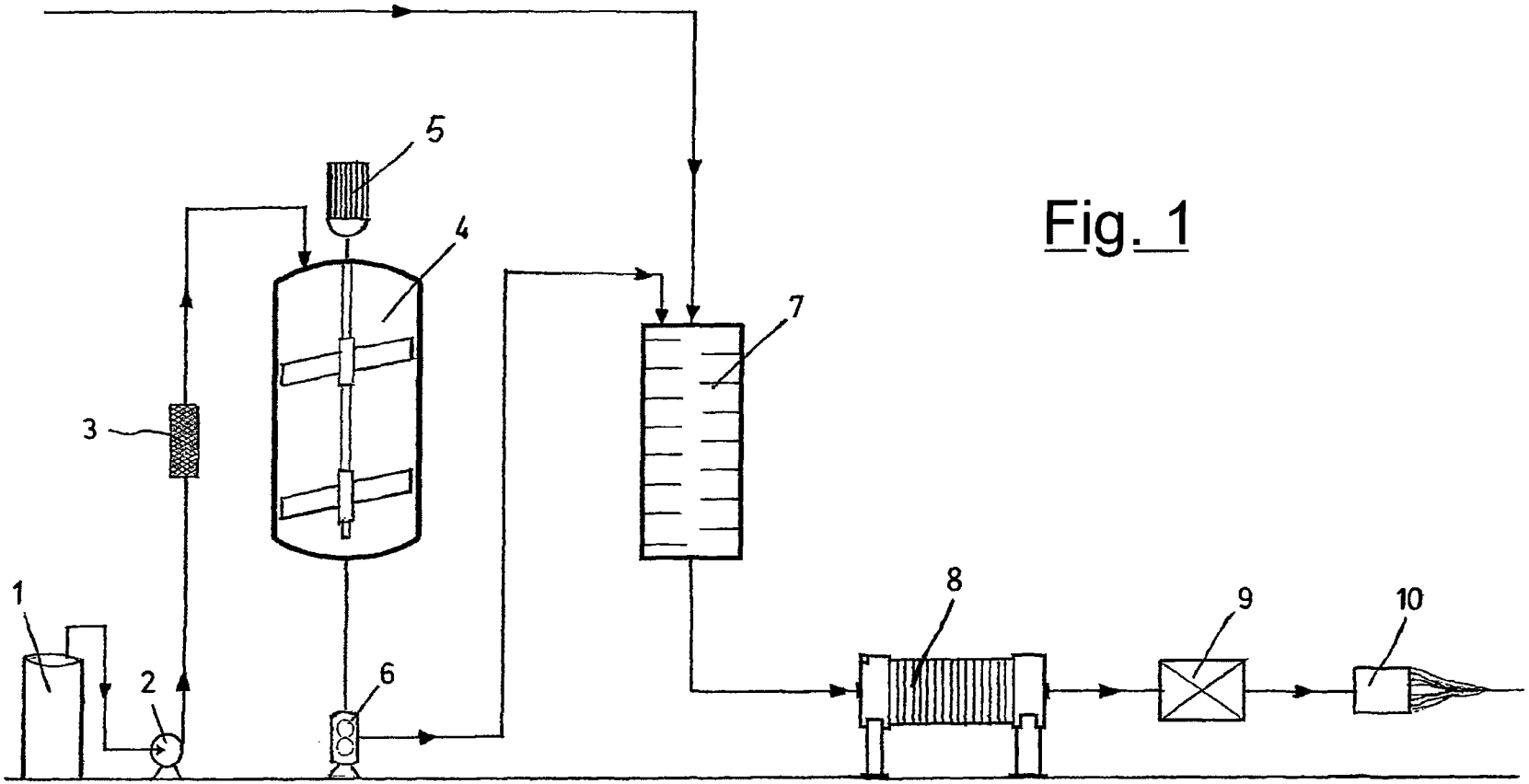
FIG. 1 shows an embodiment of the process including predispersion/dissolution; dosage; mixing; filtration; and wet spinning.

In view of these objectives, a first aspect of the present invention relates to a process for the production of cellulose-based fibres and in particular a continuous flame-retardant cellulose yarn, as disclosed in claim 1.

In general, the process according to an aspect of the invention comprises the addition of one or more flame-retardant additives belonging to the group of organophosphoric compounds to a cellulose viscose solution (cellulose xanthogenate) which limits:

coagulation phenomena;

the formation of a non-homogeneous dispersion which is incompatible with the subsequent spinning phase.

The Applicant has also found that the use of flame-retardant additives selected from organophosphoric compounds in particular having an average particle-size of about 10 microns, allows continuous flame-retardant fibres or yarns to be produced with good mechanical resistance characteristics. Among the group of organophosphoric additives which can be used within the scope of the invention, the compound 1,3,2-dioxaphosphorinan-2,2-oxy-bis-(5,5-dimethyl-2-sulphide) has proved to be particularly suitable.

It has been found that this compound can be incorporated inside the structure of the viscose fibre without changing the fibre itself which would jeopardize the mechanical resistance properties even after continuous yarn spinning.

The Applicant has also found that by using a further specific flame-retardant additive combined with the organophosphoric additive, an improvement in the flame-retardant characteristics of the fibre is obtained.

In particular, particular advantages are obtained in terms of an increased flame-development resistance and a reduction in the production costs using a flame-retardant additive selected from tetrabromobisphenol A, sodium silicate and mixtures thereof, combined with said organophosphoric additive.

Tetrabromobisphenol A is known with the abbreviation TBBPA or the IUPAC name 2,2'6,6'-tetrabromo-4,4'-isopropylidendiphenol. As this compound is highly soluble in a strongly alkaline environment, such as that of the solution of cellulose xanthogenate, it does not interfere with the filtration process. During the washing phase with sulphuric acid, this additive reprecipitates in solid and insoluble form inside the yarn.

According to an embodiment this additive can be added until a percentage equal to 5% by weight with respect to the weight of the dry yarn, is reached.

Sodium silicate, the other additive which can be used in a combination with the organophosphoric compound, has the general formula $Na_2O*nSiO_2$. This compound is extremely soluble in water also at a high concentration forming high viscosity solutions, called liquid glass. Once it comes into contact with the washing acid ($H_2SO_4$), it also precipitates forming extremely insoluble $SiO_2$ and with a flame-retardant effect.

According to another aspect of the invention, the Applicant has found various specific operating conditions which allow a homogeneous dispersion to be obtained of the flame-retardant additive belonging to the group of organophosphoric compounds in a standard viscose solution (viscose xanthogenate) producing a continuous fire-resistant yarn.

The Applicant has observed that by mixing a dispersion containing a flame-retardant organophosphoric additive with a solution of cellulose xanthogenate inside a static mixer, a homogeneous dispersion of the additive is obtained within the solution of cellulose xanthogenate.

According to an embodiment, a solution containing one or more of the following solutions can be added to the mixture of the organophosphoric derivative:

Solution in caustic soda of tetrabromobisphenol A (TBBPA). Although TBBPA is extremely insoluble in water, it has a certain solubility in caustic soda, typical of products belonging to the phenol group.

Solution in water of sodium silicate.

The static mixer used typically comprises a series of mixing elements inserted inside a tube having a suitable length. 10-14 mixing elements are preferably adopted each comprising a short propeller rotated by 180° with alternating parts in the right and left area of the tube which has a length ranging from 800 to 1200 mm. Each element is aligned at 90° with respect to the subsequent element. The mixing propeller directs the flow of material radially towards the walls of the duct and backwards towards its centre. The inversion of the velocity direction and the division of the flow are the result of the combination of alternating elements situated at the inner sides of the duct which increase the mixing efficiency. The whole material is therefore completely and continuously mixed, eliminating radial temperature, velocity and composition gradients.

It has also been observed that a better homogeneity can be reached using a suitably made dynamic mixer instead of a static mixer, i.e. suitable for continuously mixing a high viscosity solution with a low viscosity solution/suspension.

In a subsequent phase, the dispersion produced in the static or dynamic mixer is subjected to filtration to allow the removal of the agglomerates of additive before the extrusion phase. The filtration is conveniently effected through at least two steps. The first filtration step typically envisages the use of a filter press with a filtrating septum capable of withholding particles preferably having dimensions higher than 10 microns.

The second step comprises the use of a disk filter capable of withholding particles conveniently greater than 30 microns so as to remove possible coagulates formed which could block or slow down the subsequent extrusion.

The incorporation of these additives in the viscose fibre is conveniently effected following the formation process of a colloid previously described. In order to facilitate the dispersion operations, it is also appropriate for the additives to be predispersed (or dissolved) in water before being mixed with the viscose solution. The pre-dispersion (dissolution) of the additive in aqueous phase is conveniently effected inside a tank equipped with a stirring system. A suitable quantity of water is added to the tank in order to obtain an adequate concentration of solid, for example ranging from 10 to 20% by weight.

The aqueous pre-dispersion of additive is then transferred to the static mixer preferably using a dosage pump of the volumetric type. The flame-retardant additive is dosed so as to obtain an overall quantity not lower than 10%, preferably not lower than 15% by weight calculated with respect to the dry yarn.

The characteristics and advantages of a process for the production of flame-retardant viscose fibres according to the present invention will appear more evident from the following illustrative and non-limiting description, referring to the enclosed schematic drawing which illustrates an embodiment in five phases of the process of the invention.

With reference to FIG. 1, this shows an embodiment of the process which envisages the following phases:

a) predispersion/dissolution of the additive or additives in aqueous phase;

b) dosage of the predispersion in the solution of cellulose xanthogenate;

c) mixing process of the aqueous predispersion in the solution of cellulose xanthogenate;

d) filtration of the cellulose xanthogenate added. Said filtration is effected in two phases.

e) wet spinning to allow a spinning stability and good mechanical characteristics of the end-product.

In particular, in the predispersion phase a), a dispersion in water of a flame-retardant organophosphoric additive is charged into a tank 1 equipped with a suitable stirring system. The commercial dispersion is conveyed by a centrifugal pump 2 into the tank 4 passing through a cartridge filter 3 typically having dimensions of about 10 microns.

A effective dispersion of the additive is effected in the tank 4 by the addition of a suitable quantity of demineralized water, coming from a container 5, so as to obtain a final concentration of solid preferably ranging from 10 to 20% by weight.

The dosage of the additive is subsequently effected according to phase b) of the process. This phase avails of the use of a suitable dosage pump 6 which allows the removal and transferal of the predispersion into a colloidal solution of cellulose xanthogenate coming from the production process. The dosage pump 6 used is preferably of the volumetric type to guarantee precision and constancy of the dosage.

In order to have significant flame-retardant properties, the additive is present in a quantity preferably not lower than 10% calculated with respect to the dry yarn.

The subsequent phase c) of the process envisages mixing, inside a static mixer (or alternatively a dynamic mixer), to obtain a homogeneous distribution of the predispersion of the flame-retardant additive in the solution of cellulose xanthogenate. The two liquids to be mixed have very different viscosities, and the mixer must therefore have a suitable length and geometry and must also be fed within a certain flow-rate range.

An ISG Motionless Mixer 3"×14 is preferably used. The ISG (Interfacial Surface Generator) comprises separate individual mixing elements inside the tube. The terminal part of the elements is produced so as to create a tetrahedral chamber with the adjacent element.

Four holes passing through each element convey the flow; the holes are at oblique angles so that the material close to the walls of the tube is then sent towards the centre and, in the passage to the subsequent element, the flow is inverted from the centre towards the wall. This is therefore a radial mixing which eliminates the adhesion effect to the walls of the tube which may occur particularly in the mixing of more viscous fluids. Using this type of mixer 7, an optimum predispersion of the additive was obtained before passing to the subsequent filtration phase e).

In this phase, possible agglomerates of solid additive are removed before the extrusion process.

Phase e) is preferably effected with the use of two filtration steps in series. The purpose of these filters is to drastically remove the agglomerates of materials formed after the action of the mixer.

The first filtration step typically envisages the use of a filter press 8 with a filtering septum capable of withholding the finer particles. The filtering unit conveniently comprises a filter press consisting of 8 filtering plates per 15 spinning rolls. Each plate is equipped with heavy Mako cloth+ cellulose cloth from linters+rubberized cloth.

The purpose of the cards is to withhold agglomerates with dimensions greater than 10 microns: the density is 0.37 g/cm$^3$, the basis weight 425 g/cm$^2$ and the thickness 1.15 mm.

Figure 2:
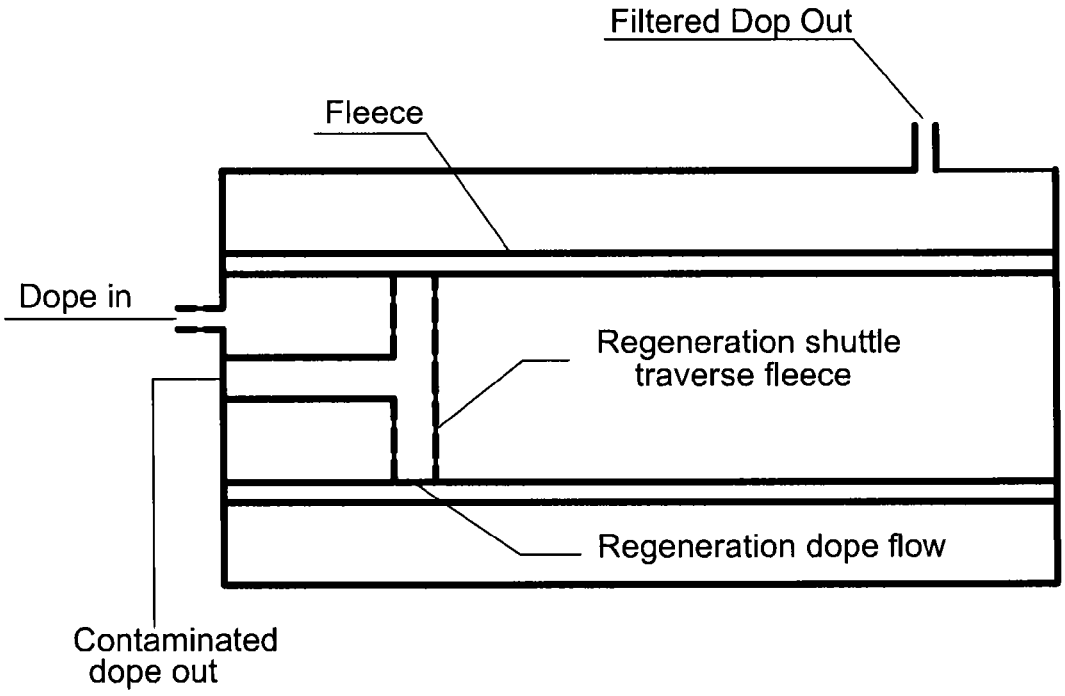
FIG. 2 shows a back-flow filter having a metallic net supported inside a metallic cylinder.

The Applicant has observed that analogous results from the point of view of filtration degree and better results with respect to the duration and management of the plant can be obtained with the use of a self-cleaning filter such as a back-flow filter as illustrated in FIG. 2 enclosed. This filter, which typically does not require periodic filtration interventions, comprises a metallic net supported inside a metallic cylinder. The steel filtering net typically has a nominal dimension of the holes equal to 10 μm.

Once the filter has exhausted its filtering capacity, there is a device which is capable of "washing" the net using an aliquot of the filtered solution. This washing is effected on one section of the net at a time, so that the remaining sections can contemporaneously continue the filtering operation. The amount of solution used for the counter-washing is then disposed of separately.

This is followed by a second step on a nylon disk filter 9 with a capacity for withholding particulates having dimensions greater than 30 microns: the purpose of this filter is to block possible materials coming from lines or the press upstream following maintenance changes, etc.

The solution thus obtained allows a continuous acceptable spinning for longer than 15 days without significant problems of breakages, coagulations, titer reductions, etc.

The solution is then transferred to the die 10 for the spinning of a continuous flame-retardant viscose yarn.

During the spinning phase, the cellulose is generated from the viscose into a fibrous form: at the outlet of the die, the viscose (cellulose content about 8%) encounters the coagulation bath which causes the coagulation of the viscose and hydrolysis of the xanthogenate. The filaments obtained under the stretching action in plastic phase are orientated, and the yarn obtained then passes through various purification and preparation operations for the subsequent uses.

The dosage of the viscose is effected by means of spinning regulators (gear pumps); the dies are made of corrosion-resistant metals (alloys such as gold-platinum-iridium), with a number of holes of up to 200 (the number of holes is equivalent to the number of filaments of which the continuous fibre consists), with a diameter of the capillaries ranging from 50 to 200 μm; in addition to circular holes, the dies can have differently shaped holes to produce flat, trilobated filaments, etc.

The die is immersed in the coagulation bath, a saline solution having a high acidity which contains:

- Sulphuric acid
- Sodium sulphate and zinc sulphate, (slowing down the hydrolysis of the xanthic groups)
- Various modifiers (aliphatic and cyclic amines, polyoxyethyleneglycols, amides of oxyethylated fatty acids, etc, which facilitate extrusion, contact with the reagents and improve the stability of the xanthogenate during hydrolysis, etc.)

Contact with this bath at the outlet of the die hole neutralizes the alkalinity of the viscose, causing the immediate coagulation of the xanthogenate (no longer soluble in an acid environment) and hydrolysis, with demolition of the compound and by-products, loss of sulphur and consequent regeneration of the cellulose fibres.

This takes place progressively starting from the surface of the liquid thread which advances and penetrates inside until the whole filament is neutralized and coagulated.

In the meantime, the hydrolysis has also initiated and it is believed that in the first advance section of the thread, the xanthate has only decomposed to a fine surface layer, with the formation of a cuticle or skin. As the filament advances, the chemical reactions which regenerate the cellulose extend to the whole filament mass, from the outside (skin) to the inside (core).

It is possible to act on the composition of the bath to accelerate or delay the regeneration: in particular, zinc salts have a delaying action.

By increasing the content of these salts, filaments can be obtained with a preponderance of skin, whereas by reducing the percentage of zinc present, filaments in which the core prevails are obtained.

The skin is characterized by a more compact morphological structure, with more orientated fibres whereas the core has a less orientated fibrous structure. The delaying action of the zinc salt is due both to the lesser permeability of the skin formed in its presence, which therefore slows down the penetration, and also to the greater stability of the zinc xanthate with respect to sodium xanthate with a consequently slowing down of the decomposition.

The coagulation bath flows continuously fed by a recovery plant which continuously receives the return bath from the spinner. The exhausted bath has consumed part of the acid (used to neutralize the alkalinity of the viscose) and is enriched with salt (formed by the neutralization) and diluted with the water of the viscose; in addition to this it contains sulphurated products. The recovery comprises degasification, for the volatile sulphurated products, elimination of the excess salt as crystalline $Na_2SO_4$, elimination of the excess water by concentration and reintegration of the acid used up, in addition to a filtration.

During the regeneration, the yarn can be subjected to stretching, which produces the orientation of the cellulose chains modifying the morphological structure of the fibre, responsible for the textile characteristics of the product. In the classical process, the stretching and completion of the regeneration can be effected after the extrusion. In yarns for normal textile use, the average stretching is in the order of 10-50%, for yarns with special filaments it can also be much higher.

The viscose obtained has titers which vary from 60 den to 600 den. The fibre is continuous and multifilament. With the process of the invention, it is possible to produce both the shiny and opaque type, and dyed in mass in numerous colours. The mechanical properties of the continuous flame-retardant yarn obtained fall within the limits envisaged for standard products.

The main organophosphoric additive exerts its flame-retardant function inside the fibre, acting in solid phase, favouring the carbonization of the substrate and consequently slowing down flame propagation. The heated phosphorous reacts producing polymeric phosphoric acid, the latter causes the carbonization of the cellulose material with the formation of a vitreous layer which inhibits the pyrolysis mechanism, no longer fed by gaseous fuel. Furthermore, the intumescent layer protects the underlying polymer from the heat of the flame.

The secondary additives act according to the following mechanisms:

- the TBBPA acts in gas phase poisoning the flame, i.e. at the moment in which the substrate burns, it releases gases which slow down or inhibit the combustion process.
- the silicate, on the other hand, has an analogous mechanism to that of the organophosphoric compound, i.e. it facilitates the carbonization of the substrate (charring).

As viscose is a non-thermoplastic compound, when fabrics based on the fibre obtained with the process of the invention are subjected to free flames, they do not tend to melt, and are therefore not subject to the harmful effects to which fabrics produced with synthetic thermoplastic fibres such as nylon or polyester are subjected. When these materials are subjected to free flames, in fact, they tend to release incandescent drops which can propagate the fire, they also tend to shrink and create a hole in the fabric, thus annulling the protective function.

With the same mass, moreover, synthetic fibres release a much greater quantity of heat with respect to cellulose fibres.

An index which measures the facility with which a material burns is LOI (limiting oxygen index), it represents the minimum percentage of oxygen sufficient for maintaining combustion of the substance under examination. The greater the index, the lesser the tendency to burn will be.

Standard viscose has a LOI index of 18, the viscose containing additives obtained with the process of the invention has a LOI index conveniently ranging from 28-30.

The continuous flame-retardant viscose yarn of the invention, in titers of 220/46 and 330/56 has been tested in various national and foreign laboratories obtaining certifications. In particular, the viscose fabric of the invention has passed combustion tests according to BS5852 (1990).

As the flame-retardant additive remains dispersed inside the mass and as it is insoluble in water, the properties described do not deteriorate during the normal treatment to which the fibres are subjected during their processing and during the life of the end-product produced therewith (washing resistance).

The fibre and continuous yarn obtained with the process of the invention are applied in the textile industry for producing clothes, linings, outdoor knitwear and in furnishing for example in the production of fabrics for the covering of padding such as padded furniture, for protective clothing mixed with other intrinsically flame-retardant fibres or in drapery and curtaining mixed with other flame-retardant fabrics.

The fabric obtained with the process of the invention also has excellent transpirability and antistatic properties together with a good mixability with other fibres such as wool, acetate, silk, polyamide, linen and cotton.

The following example is provided for purely illustrative purposes of the present invention and should not be considered as limiting the protection scope as indicated in the enclosed claims.

EXAMPLE 1

A fabric lining made of viscose according to the present invention was tested, having a weft of 300 den/0 20.5 T/cm, a chain 300/400 23 yarns cm containing 15% by weight of 1,3,2 dioxaphosphorinan-2,2-oxy-bis(5,5-dimethyl-2-sulphide) calculated with respect to the dry yarn, coupled with a padding made of polyurethane NLTX 35F having the following characteristics: density 35 kg/m$^3$, compression stress 3.3 kPa, tensile strength 80 kPa, elongation 100%, elastic yield 60% in accordance with the fire reaction group 1 IM.

When subjected to the UNI 9175-9175/FA-1 test, the viscose lining proved to be inflammable after passing three series of tests.

The invention claimed is:

1. A process for the production of flame-retardant fibres or a continuous yarn based on viscose, comprising:

- mixing a solution of cellulose xanthogenate with an aqueous dispersion of a flame-retardant organophosphoric additive in a mixer to obtain a homogeneous dispersion of said additive,
- filtering the colloidal mixture formed to remove the solid coagulates formed,
- spinning the filtered colloidal mixture through one or more dies in a regenerating and coagulation bath,
- wherein the mixing is effected in a static or dynamic mixer, and
- the filtering comprises a first filtration step in which particles with dimensions greater than 10 microns are withheld and a second step in which reformed particles or coagulates with dimensions greater than 30 microns are withheld.

2. The process according to claim 1, wherein said flame-retardant organophosphoric additive is 1,3,2-dioxaphosphorinan-2,2-oxy-bis-(5,5-dimethyl-2-sulphide).

3. A textile article having fireproof properties comprising a continuous viscose fibre or yarn made according to the process of claim 2.

4. The process of claim 2, comprising:

forming a preliminary dispersion phase in water of the flame-retardant additive inside a tank equipped with a stirring system to obtain a total concentration of said additive in the predisperson/solution of from 10 to 20% by weight.

5. The process according to claim 1, wherein said organophosphoric additive is associated with at least one other flame-retardant additive selected from the group consisting of tetrabromobisphenol A, sodium silicate and mixtures thereof.

6. The process according to claim 1, wherein the colloidal mixture is filtered with a filter press or a self-cleaning filter in the first filtration step and the colloidal mixture is filtered with a disk filter in the second filtration step.

7. The process according to claim 1, comprising:

forming a preliminary predispersion phase in water of the flame-retardant additive inside a tank equipped with a stirring system to obtain a total concentration of additive ranging from 10-20% by weight.

8. The process according to claim 7, wherein the aqueous dispersion is dosed with the flame-retardant additives in the solution of cellulose xanthogenate.

9. The process according to claim 8, wherein said additives are present in a quantity of not lower than 10% by weight calculated with respect to the weight of the dry yarn.

10. The process according to claim 8, wherein said additives are present in a quantity not lower than 15% by weight calculated with respect to the weight of the dry yarn.

11. A textile article having fireproof properties comprising a continuous viscose fibre or yarn made according to the process of claim 8.

12. A continuous fiber or yarn based on viscose with flame-retardant properties obtained by the process according to claim 1.

13. A textile article having fireproof properties comprising a continuous viscose fibre or yarn according to claim 12.

14. The article according to claim 13, selected from the group consisting of clothing items, linings, furniture coverings, furniture padding, drapery and curtaining.

15. The continuous viscose fibre or yarn according to claim 12, having a LOI index ranging from 28-30.

16. A continuous viscose fibre or yarn according to claim 12 having a total content of flame-retardant organophosphoric additive of from 10 to 20% by weight with respect to the dry yarn.

17. The process of claim 1, wherein the flame-retardant organophosphoric additive further comprises tetrabromobisphenol A.

18. The process of claim 1, wherein the flame-retardant organophosphoric additive further comprises sodium silicate.

* * * * *